US007645216B2

(12) United States Patent
Edeker

(10) Patent No.: US 7,645,216 B2
(45) Date of Patent: Jan. 12, 2010

(54) DUAL CAM EXERCISE DEVICE METHOD AND APPARATUS

(76) Inventor: Kurt William Edeker, 2401 Keepsake Dr., Austin, TX (US) 78745

( * ) Notice: Subject to any disclaimer, the term of this patent is extended or adjusted under 35 U.S.C. 154(b) by 0 days.

(21) Appl. No.: 11/800,513

(22) Filed: May 7, 2007

(65) Prior Publication Data

US 2008/0132391 A1 Jun. 5, 2008

Related U.S. Application Data

(60) Provisional application No. 60/800,877, filed on May 17, 2006.

(51) Int. Cl.
*A63B 21/00* (2006.01)
*A63B 21/062* (2006.01)

(52) U.S. Cl. ..... 482/92; 482/100

(58) Field of Classification Search ..... 482/92, 482/93, 100, 63, 61, 51, 50, 79, 91, 110, 482/120

See application file for complete search history.

(56) References Cited

U.S. PATENT DOCUMENTS 4,200,279 A * 4/1980 Lambert, Jr. ..... 482/100
4,322,071 A * 3/1982 Lambert et al. ..... 482/100
4,478,411 A * 10/1984 Baldwin ..... 482/136
4,600,189 A * 7/1986 Olschansky et al. ..... 482/100
4,711,448 A * 12/1987 Minkow et al. ..... 482/100
4,722,522 A * 2/1988 Lundgren ..... 482/97
5,104,121 A * 4/1992 Webb ..... 482/137
5,171,200 A * 12/1992 Jones ..... 482/134
5,273,508 A * 12/1993 Jones ..... 482/136
5,286,243 A * 2/1994 Lapcevic ..... 482/97
5,338,274 A * 8/1994 Jones ..... 482/100
5,354,252 A * 10/1994 Habing ..... 482/100
5,413,546 A * 5/1995 Basile ..... 482/99
5,447,480 A * 9/1995 Fulks ..... 482/99
5,468,202 A * 11/1995 Habing ..... 482/100
5,554,085 A * 9/1996 Dalebout ..... 482/137
5,580,341 A * 12/1996 Simonson ..... 482/100
5,597,375 A * 1/1997 Simonson ..... 482/100
5,620,402 A * 4/1997 Simonson ..... 482/72
5,667,465 A * 9/1997 McCollum et al. ..... 482/100
5,885,193 A * 3/1999 Habing et al. ..... 482/92
6,228,000 B1 * 5/2001 Jones ..... 482/8
6,302,833 B1 * 10/2001 Ellis et al. ..... 482/100
6,364,815 B1 * 4/2002 Lapcevic ..... 482/97
6,409,637 B1 * 6/2002 Webber et al. ..... 482/99
6,558,303 B1 * 5/2003 Ellis ..... 482/138

(Continued)

FOREIGN PATENT DOCUMENTS

GB 2223686 A * 4/1990

*Primary Examiner*—Loan H Thanh
*Assistant Examiner*—Sandhara M Ganesan

(57) ABSTRACT

A device for resistance exercise of muscle groups that cross two or more joints such as biceps group, triceps group, quadriceps group, and hamstring group. The device comprises a primary cam or gear fixed non-rotatably to the frame of an appropriate exercise machine for working the desired body part, and a secondary cam or gear connected only to the primary cam in such a way which, when rotated, tracks around the primary cam or gear. Resistance is provided with a cable, belt, chain, or other means to the axis of the secondary cam only. When properly positioned user applies force to the contact point connected to the secondary cam and secondary axis, the device moves both desired joints simultaneously through a range of motion while under a predictable resistance. The device provides an improved range of movement while under resistance, thereby supplying a greater extension and contraction of the desired muscle or muscle group than prior art devices.

11 Claims, 6 Drawing Sheets

U.S. PATENT DOCUMENTS 6,575,881 B2 * 6/2003 Lapcevic ..... 482/97
6,676,573 B2 * 1/2004 Abelbeck et al. ..... 482/95
6,676,574 B1 * 1/2004 Prokop et al. ..... 482/100
6,746,378 B2 * 6/2004 Morris et al. ..... 482/100
6,896,643 B2 * 5/2005 Durfee, Jr. ..... 482/100
7,029,427 B2 * 4/2006 Vuurmans et al. ..... 482/100
7,070,544 B1 * 7/2006 Rindfleisch ..... 482/97
7,083,554 B1 * 8/2006 Lo Presti ..... 482/137
7,223,213 B2 * 5/2007 Golesh ..... 482/100
7,396,319 B1 * 7/2008 Ellis ..... 482/100
2004/0082444 A1 * 4/2004 Golesh ..... 482/99
2005/0124470 A1 * 6/2005 Schopf ..... 482/100
2006/0100069 A1 * 5/2006 Dibble et al. ..... 482/98

* cited by examiner

Four Dual Joint/Dual Cam Devices arranged for each limb in a total body cardio configuration equal to running on all fours "The Cheeta"

DUAL CAM EXERCISE DEVICE METHOD AND APPARATUS

RELATED APPLICATIONS

This U.S. Non-provisional patent application is related to U.S. Provisional Patent Application No. 60/800,877 filed May 17, 2006 and claims the benefit of that filing date.

FIELD OF INVENTION

The current invention is an improved exercise apparatus and method, more specifically an improved exercise device with a dual cam to permit effective exercise of any muscle group that crosses more than one joint such as the biceps, triceps, quadriceps, and hamstring. The current invention is not limited to these muscle groups only.

BACKGROUND OF INVENTION

In the human body there are a small number of muscles that cross two joints. These muscles, in combination with supporting muscles, are capable of moving both joints simultaneously. All existing exercise equipment is designed to exercise a muscle involving only one joint of the body. This does not work the muscle over the full range of motion and is thus not optimal to stimulate full muscle growth, rehabilitation or conditioning.

These muscle groups include but are not limited to; the biceps group of the upper arm, the triceps group of the upper arm, the quadriceps group of the upper leg, and the hamstring (or biceps femoris) group of the upper leg. The full range of motion and exertion of these unique muscles move two joints as they work through their full range of contraction. The biceps and triceps groups move both the elbow and shoulder joints. The quadriceps and hamstring groups move the knee and hip joints.

To properly work these muscles, the muscles must have resistance through their entire range of motion from full extension of both joints to full flexion of both joints.

The current invention is an apparatus to permit such a range of resistance exercise.

SUMMARY OF INVENTION

It is the purpose of this invention to provide a method and device to exercise the groups of muscles that cross more than one joint thereby achieving a superior extension, contraction and overall workout.

The primary muscle groups to be worked with the current invention are biceps of the upper arm, triceps of the upper arm, quadriceps of the upper leg and the hamstrings of the upper leg. The device is not limited to these uses.

The device of the current invention may be adapted to many different uses and exercise machines.

This invention can be incorporated into any of a family of machines that will place the user in a position such that the desired body part is placed in full muscle extension. By engaging the device, the targeted muscle will be guided through the full range of motion from full extension to full contraction while under resistance.

One purpose of the device is to move two joints of the same limb through their full range of motion while under resistance, such that a secondary cam will move around a fixed primary cam.

BRIEF DESCRIPTION OF THE DRAWINGS

FIG. 2(2) is a side view illustrating the indirect tracking of a secondary gear or cam around a fixed primary gear or cam using a connecting means such as cable, rope, chain, etc.

FIG. 3(2) is a side view illustrating another method of changing the vector and direction of resistance applied to the secondary cam or gear by the attachment of a resistance line to the resistance cam in a different direction.

FIG. 4(2) is a side view showing one embodiment of the current invention for exercising triceps.

FIG. 4(3) is a side view showing one embodiment of the current invention for exercising quadriceps.

FIG. 4(4) is a side view showing one embodiment of the current invention for exercising hamstrings.

The current invention is not limited to this or any other stated embodiment. These are merely demonstrations of its possible uses.

DETAILED DESCRIPTION OF EMBODIMENT

Dual Cam Assembly

One aspect of the current invention is the ability to incorporate a dual cam assembly into various types and models of exercise equipment. The dual cam assembly provides a method for exercising limbs through a full range of motion. The current invention may be used in any exercise motion that requires or is aided by a concentric or eccentric arc in its range of motion.

The term "cam" is used in this specification and claims to refer to a cam, wheel, pulley or gear of any shape with or without teeth or other self interlocking features.

The term "cam connection" used in this specification and claims refers to a belt, chain, or other technique for directly or indirectly rotating the secondary cam around a portion of the periphery of the primary cam. Typically, a line of resistance acts on either the primary cam or the secondary cam, and the cam connection means transfers at least a portion of that resistance to the other cam. In the current invention a line of resistance acts only on the secondary cam, wheel, gear, etc. transferring none of the resistance directly to the primary fixed cam. In the case of gears, the cam connection is mated gear teeth between the primary gear and the secondary gear.

The term "muscle" or "muscle group" refers to a muscle group which crosses two joints. Examples include but are not limited to the biceps group, the triceps group, the quadriceps group, and the hamstring group.

Example Components of Dual Cam Assembly

Figure 1:
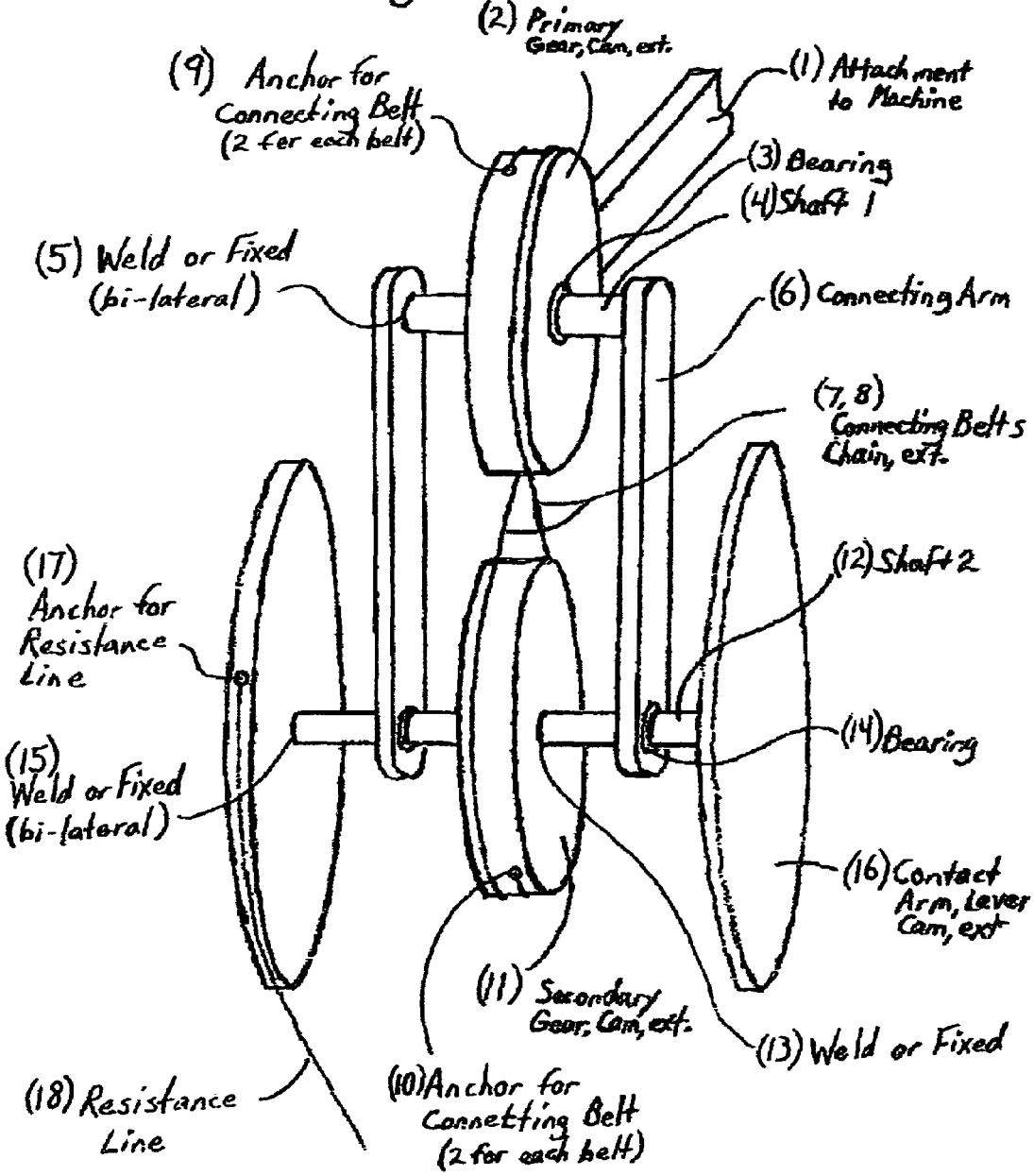
FIG. 1 is a front perspective view of a portion of an exercise apparatus with a line of resistance, the apparatus comprising a fixed primary cam or gear, a secondary gear or cam, a connecting means such as a belt or chain between the primary cam and the secondary cam, and a body contact means such as an arm, lever, or cam.

FIG. 1 is a front perspective view of a portion of an exercise apparatus with a line of resistance 18, and a body contact means 16, such as an arm, lever, or cam. The dual cam assembly includes a primary cam 2, a secondary cam 11, a connecting means 7,8 such as a belt or chain between the primary cam and the secondary cam.

In this example, the primary or proximal pivot point 2 is stationary and secured to the frame of an exercise machine 1. In this example, the pivot point comprises a cam 2. In other examples, the pivot point may be a gear, wheel, off center cam, or other mechanism which permits a pivoting action. The user will align his or her body so that the proximal joint of the desired body part is in alignment with the primary pivot point of the machine 2. The secondary pivot point/fulcrum 11 will be at a distance approximately equal to the distal joint of the users desired body part. The secondary or distal pivot point or fulcrum 11 will be interlocked with the primary pivot in such away as to be interlocked but when rotated it will move around the primary pivot point.

In this example, the secondary or distal pivot point comprises a cam 11. In other examples, the secondary or distal pivot point may be a gear, wheel, off center cam, or other mechanism which permits a pivoting action and permits travel with respect to the first pivot point. The primary and secondary pivot points are held together at a consistent distance by a connecting arm 6.

A first shaft 4 connects the proximal pivot gear, cam, etc. 2, to the proximal end of the connecting arm 6. The shaft 4 rotates within the fixed proximal gear 2 via a bearing 3 and is fixed to the proximal end of the connecting arm 6 via a weld, screw, bolt or any other attachment means 5.

A second shaft 12 connects the secondary gear, cam, etc. 11, to the connecting arm 6. The second shaft 12 is secured to the secondary cam, gear, etc. 11 via a weld or any apparent method 15 in such a way that when the secondary shaft 12 is rotated the secondary cam, gear, etc. 11 must move together. The second shaft 12 passing through the distal end of the connecting arm 6 will be able to rotate within the arm via a bearing or any other apparent method 14. The end or ends of the secondary shaft 12 will be fixed to a user contact arm, lever, contact plate, etc. 16 via a weld or any other apparent method 15.

A handle or pad of existing design will supply the contact point of resistance for the user. A resistance line 18 connecting the contact arm, lever, cam, etc. 16 to a form of resistance.

Direct and Indirect Tracking

Figure 2:
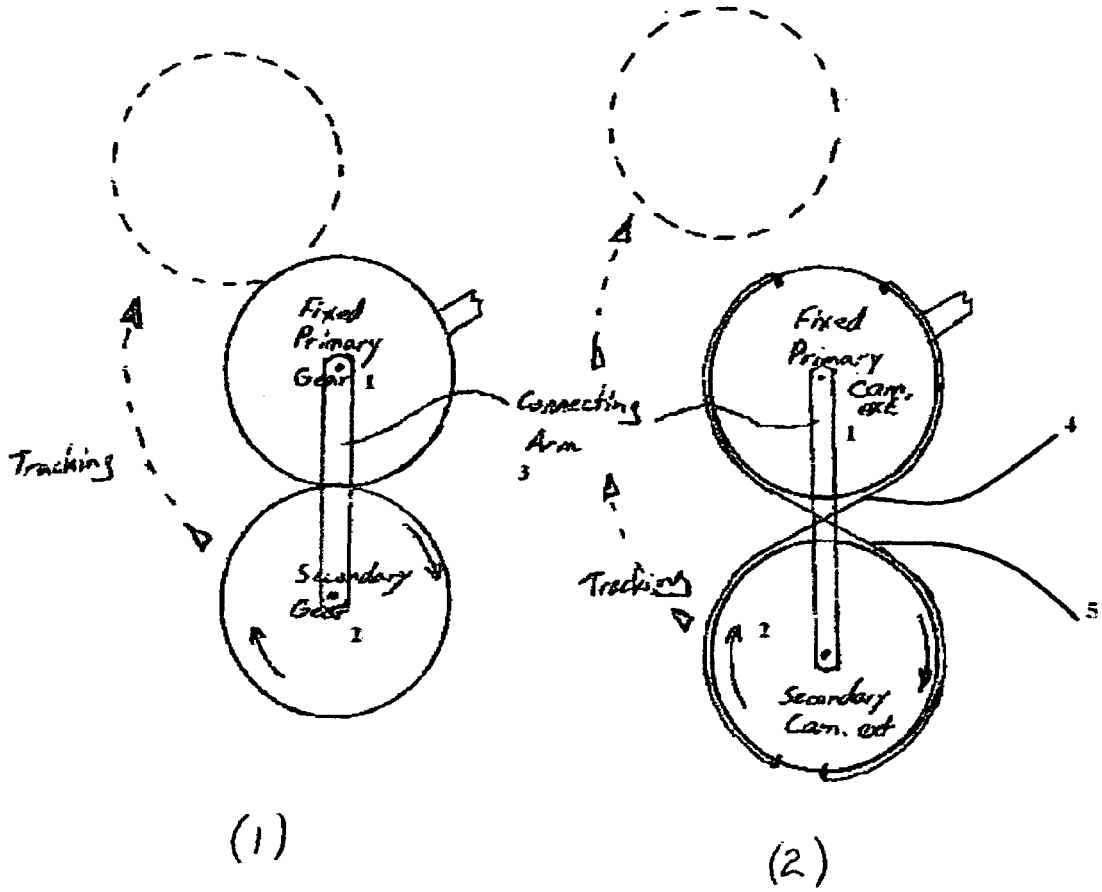
FIG. 2(1) is a side view illustrating the direct contact tracking of a secondary gear or cam around a fixed primary gear or cam.

FIG. 2.1 is a side view illustrating the direct contact tracking of a secondary gear or cam, etc. 2 around a primary gear or cam, etc. 1. The gears, cams, wheels, etc. will be in such a position so that when the secondary gear, cam, etc. 2.1.2 is rotated it will contact and track around the primary gear, cam, etc 2.1.2. These pivot points will be held in the correct approximation by a connecting arm or any type of tension device 3.

FIG. 2.2 is a side view illustrating the indirect tracking of a secondary gear, cam, etc. 2 around a primary gear, cam, etc. 1. The primary gear, cam, etc. 1 is linked to the secondary cam, gear, etc. 2 via two counter wound belts, chains, cables, etc. 4,5. These will be held at the proper distance and tension by a connecting arm or any appropriate tension device 3. One belt, chain, cable, etc. 4 would be wound clock wise on the primary gear, cam, etc. 1 and counter clockwise on the secondary gear, cam, etc. 2. The other belt, chain, cable, etc. 5 would be wound counter clockwise on the primary gear, cam, etc. 1 and clockwise on the secondary gear, cam, etc. 2. The same effect may be accomplished by a FIG. 8 configuration with the proper tension.

As in any interlocking gear system, if you rotate an unfixed gear, wheel, etc., around a fixed gear, wheel, etc., it will follow the path of the fixed gear at a predictable rate, ratio of rotation, and curve. When the secondary gear, cam, etc., is rotated clockwise it will track in a clockwise direction around the primary gear, cam, etc. (See FIGS. 2.1 and 2.2) The same applies to counter clockwise rotation of the secondary gear, cam, etc., producing counter clockwise movement around the primary cam, gear, etc.

Direction of Resistance

Figure 3:
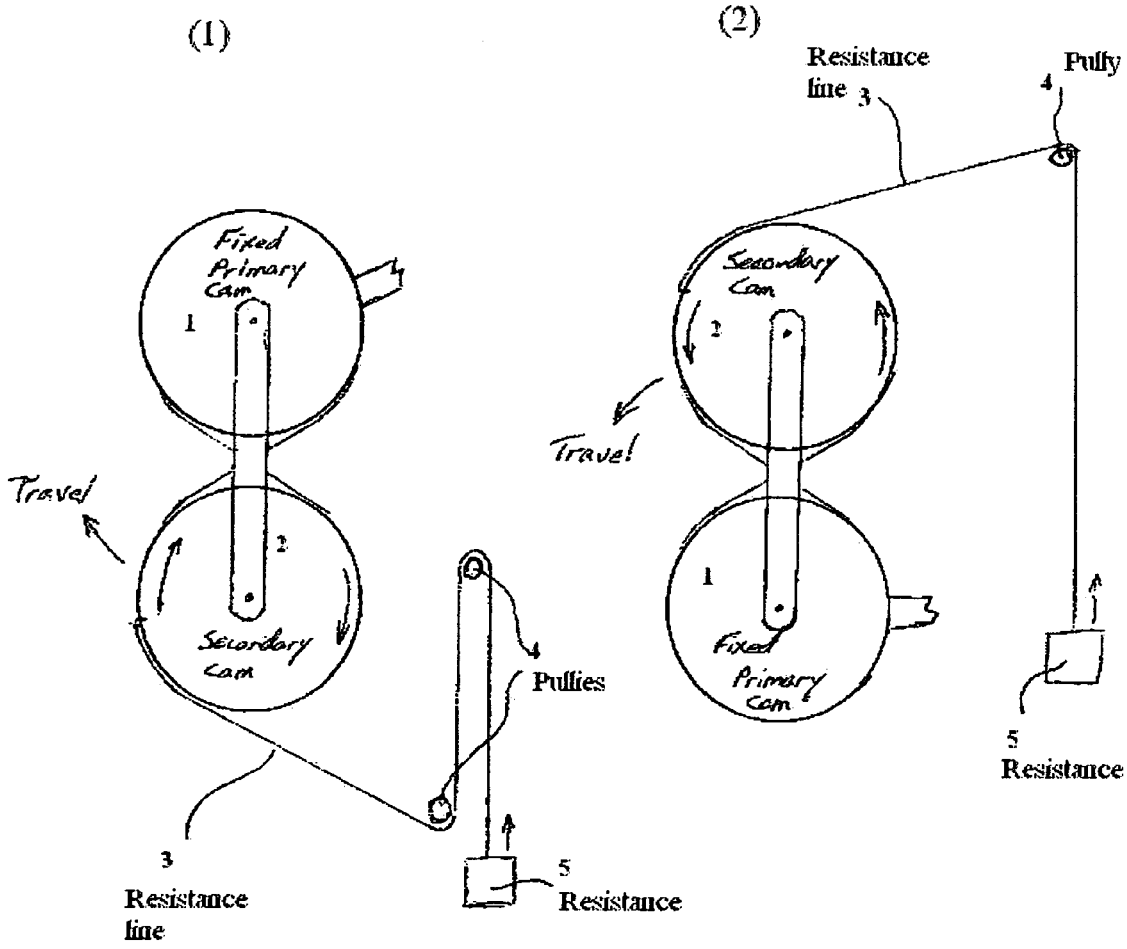
FIG. 3(1) is a side view illustrating one method of changing the vector and direction of resistance applied to the secondary cam or gear by the attachment of a resistance line secured to the contact cam.

FIG. 3.1 is a side view illustrating one method of changing the vector and direction of resistance applied to the secondary cam, gear, etc. 2 by the attachment of a resistance line 3 directed appropriately via pullies 4.

FIG. 3.2 is a side view illustrating another method of changing the vector and direction of resistance applied to the secondary cam, gear, etc. 2 by the attachment of a resistance line 3 and directed via pullies 4.

By supplying resistance to the secondary gear, cam, etc. 2, via a cable, rope, lever or any other apparent line of resistance 3 to a weight, stack, plate loading rack, hydraulics or any other apparent device 5 there will be resistance through the entire range of motion.

By changing the position of the secondary gear 2 and the placement of the resistance line 3 and pulleys 4, the direction and vector of resistance can be changed to target the desired muscle group or groups in the desired direction and vector.

The applications are not limited to the illustrations listed above.

DETAILED DESCRIPTION OF EMBODIMENT

Changing the Line of Resistance for Various Muscle Groups

One use of the current invention is to provide an exercise that moves two joints and one or more muscle or muscle groups simultaneously.

Figure 4:
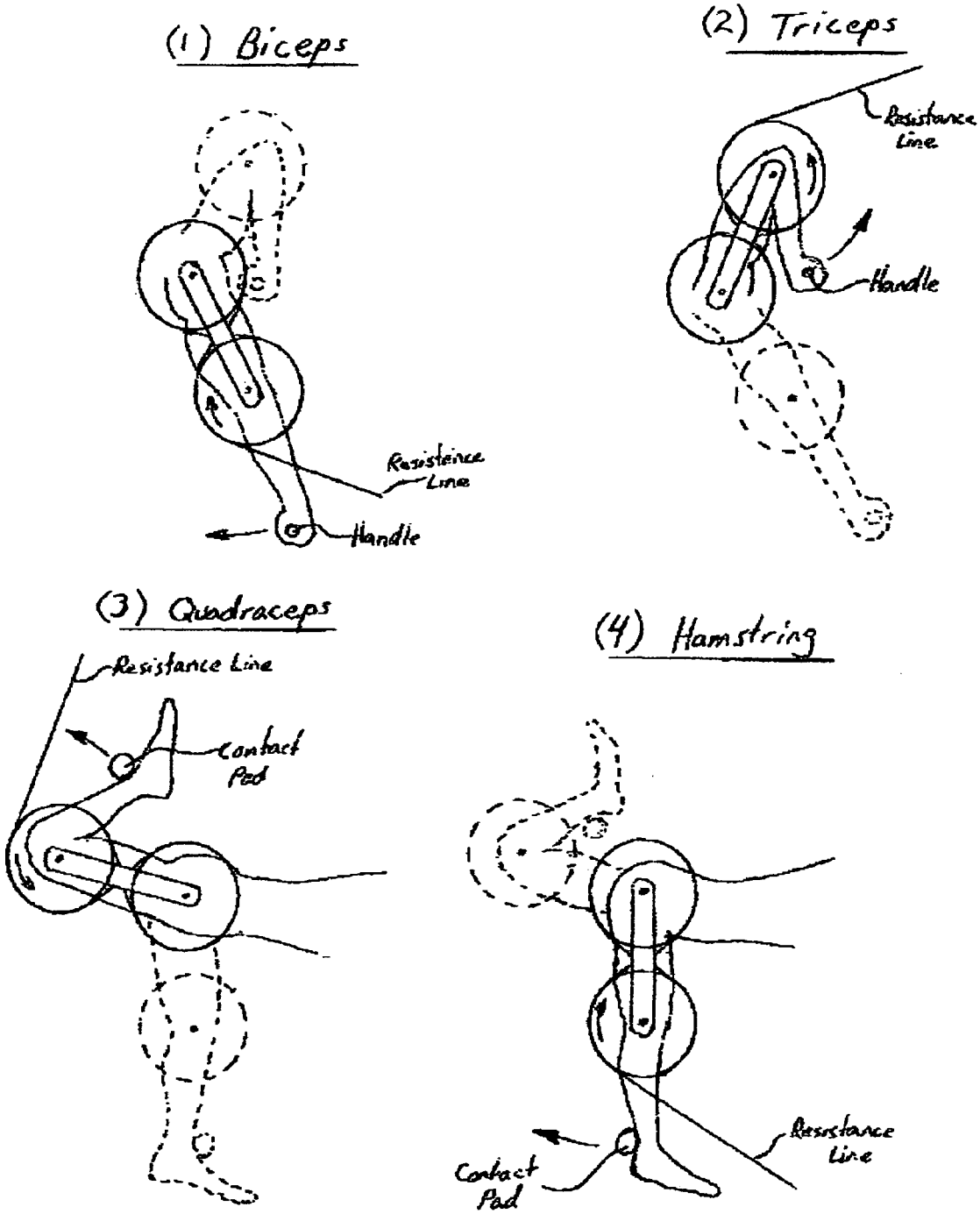
FIG. 4(1) is a side view showing one embodiment of the current invention for exercising biceps.

FIG. 4.1 is a side view showing one embodiment of the current invention for exercising biceps.

FIG. 4.2 is a side view showing one embodiment of the current invention for exercising triceps.

FIG. 4.3 is a side view showing one embodiment of the current invention for exercising quadriceps.

FIG. 4.4 is a side view showing one embodiment of the current invention for exercising hamstrings.

By changing the line of resistance, direction of resistance, position of the user, and body part being worked, it is possible to work the specified muscle groups described.

Use of this device is not limited to these examples. The device may be used for any motion that follows an eccentric or concentric arc or spiral in its execution. These may include but are not limited to: throwing motions as in football and baseball, a tennis swing, a golf swing, etc.

DETAILED DESCRIPTION OF EMBODIMENT

Bilateral Device Dual Cam Assembly

Figure 5:
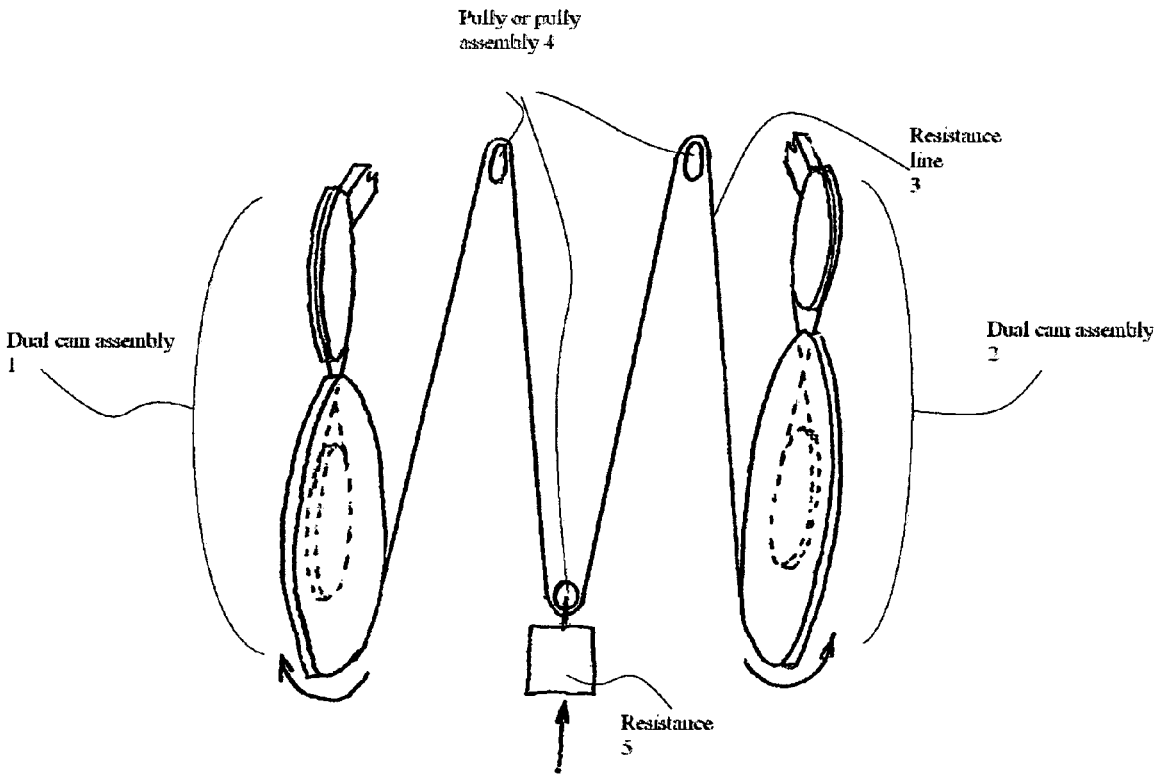
FIG. 5 is a front perspective view of a device for bilateral use. This embodiment is a generic configuration only. The design, number and placement of the pullies and guides will dictate the direction and vector of resistance. This concept will be used for any bilateral muscle group including but not limited to biceps, triceps, quadriceps or hamstrings. This can be used for one or more sources of resistance.
Figure 6:
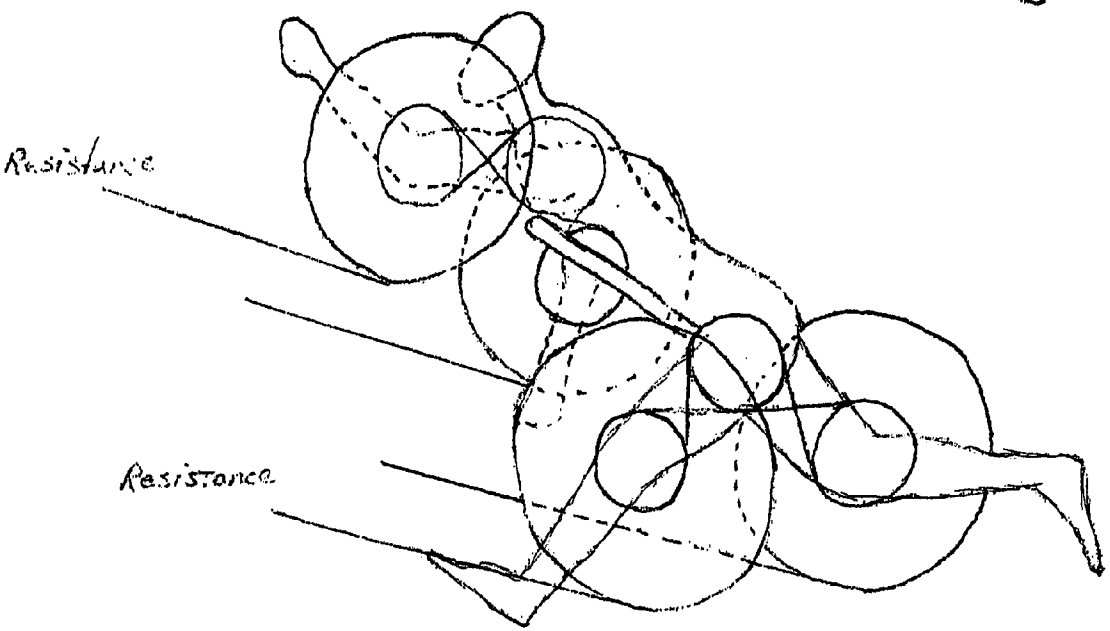
FIG. 6 is a perspective view of a device for aerobic or resistance work using all four limbs together. This embodiment is a generic configuration only. This embodiment allows for the use of all four limbs simultaneously. This device is configured in such a way as to allow each limb to be moved independently or in any combination or coordination while under resistance.

FIG. 5 The discussion above described a single pair of primary and secondary cams for exercising a limb referred to in FIG. 5 as Dual cam assembly. The technique is extended to provide two pairs or primary and secondary cams to permit the simultaneous exercise of both arms or both legs. FIG. 5 is a front perspective view of a device for bilateral use. Two dual cam assemblies 1 and 2, one the mirror image of the other are arranged such that the user may position himself in such away as to engage both assemblies simultaneously, for example both arms or both legs. The resistance line 3 will be directed via pullies or pulley arraignment of any number or any appropriate mechanism 4 in such a way as to connect assembly 1 and assembly 2 or to independent resistance devices mounted to the common frame. The resistance line 3 will be directed in such a way as to engage a form of resistance 5.

The invention claimed is:

1. A resistance exercise device for exercising a muscle or muscle group, the device comprising a frame;

a primary cam supported by and fixed to the frame in a non-rotatable manner, the primary cam having a circumference;

a secondary cam supported by a at least one connecting arm;

the at least one arm comprising a first end pivotally connected to the primary cam via the axis, and a second end pivotally connected to the secondary cam via the axis;

a cam connection between the primary cam and the secondary cam for rotating such the secondary cam around at least a portion of the circumference of the primary cam when the secondary cam is rotated;

wherein the cam connection further comprises:

a first cam connection would clockwise on the primary cam and wound counterclockwise on the secondary cam, and a second cam connection wound counterclockwise on the primary cam and wound clockwise on the secondary cam;

wherein the primary cam and the secondary cam are interlocked by the cam connection such that any rotation of the secondary cam will cause it to rotate around the primary cam;

a contact cam, plate, lever, arm, etc. fixed rigidly to the axis of the secondary cam;

a resistance line attached such that when the secondary cam is rotated the resistance line is engaged to tension;

a form of resistance attached such that when the resistance line is engaged it will move the form of resistance.

2. The device of claim 1 wherein the primary cam is rigidly non-rotatably attached to a frame of the exercise device.

3. The device of claim 1 wherein the axis of the primary cam is solidly attached to the connecting arm so as to move as one piece and the axis is able to rotate freely within the primary cam.

4. The device of claim 1 wherein the axis of the secondary cam is attached in a way so it rotates freely within the connecting arm;

further, the axis of the secondary cam is attached rigidly to the secondary cam and any contact arm, lever or plate such that they will move as one piece when rotated.

5. The device of claim 1 wherein a resistance cam is also secured, fixed to the axis of the secondary cam of a size and shape to give the desired leverage of resistance via a resistance cable, belt, or chain directed via pulleys to position and direct the resistance force of a weight stack, plate loading device or any resistance mode to target the desired muscle group.

6. The device of claim 1 wherein handle or pad of any functional design is secured to the resistance cam such that when the user engages the handle or pad with the distal portion of the desired limb and applies the correct amount of pressure it will move the resistance cam and the secondary cam around the primary cam in such a manner that both joints of the desired limb such as one or both arms, or one or both legs will move through their full range of motion depending on the muscle group being worked.

7. The device of claim 1 may be used and adapted to any movement or machine that works any muscle group or groups that cross more than one joint.

8. The device of claim 1 may be used and adapted to any exercise movement that follows a concentric or eccentric curved path or spiral.

9. The device of claim 1 may be used in single, tandem or more combinations to recruit as many of the desired muscle groups as desired; examples may include but are not limited to single biceps, double biceps, single triceps, double triceps, single quadriceps, double quadriceps, single hamstring, double hamstring, or all four limbs simultaneously.

10. A method of providing resistance exercise for a muscle or muscle group that crosses two joints of the same limb, the method requiring a resistance exercise device comprising a frame a primary cam having a circumference, the primary cam fixed non-rotatably to the frame;

a secondary cam supported by at least one arm connected only to the primary cam;

the arm comprising;

a first end connected pivotally to the primary cam via the axis, and a second end connected pivotally to the secondary cam via the axis; and the secondary axis connected rigidly to the secondary cam;

a cam connection between the primary cam and the secondary cam, such that the cam connection causes the secondary cam to rotate around at least a portion of the circumference of the primary cam when the secondary cam is rotated;

a contact cam, plate, lever, arm, etc. fixed rigidly to the axis of the secondary cam;

a resistance line attached such that when the secondary cam is rotated the resistance line is engaged to tension;

a form of resistance attached such that when the resistance line is engaged it will move the form of resistance;

the method comprising the steps of:

using the resistance exercise device to apply a resistance to a full or partial range of motion of a desired limb, muscle or muscle group;

positioning the distal joint of the desired limb such as the elbow or knee in approximate line with the axis of the secondary cam and engaging the contact plate via the handle or pad of the appropriate design; and contracting the desired muscle or muscle group, causing the resistance line to engage a form of resistance and causing the secondary cam to rotate around the primary cam such that the machine will move both the proximal and distal joint of the desired limb through a desired and designed range of motion.

11. The method of claim 10, further including the step of may using the device in a machine containing one or more of the resistance device to exercise or move one or more desired limbs, muscles or muscle groups.

* * * * *